US006250206B1

(12) United States Patent
Johnson

(10) Patent No.: US 6,250,206 B1
(45) Date of Patent: Jun. 26, 2001

(54) HYDRAULIC PISTON FILLING

(75) Inventor: Alan W. Johnson, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/247,690

(22) Filed: Feb. 10, 1999

(51) Int. Cl.[7] ..... F01B 31/10
(52) U.S. Cl. ..... 92/158; 92/248
(58) Field of Search ..... 92/71, 157, 158, 92/172, 248, 255

(56) References Cited

U.S. PATENT DOCUMENTS

| | | | | |
|---|---|---|---|---|
| 3,187,644 | | 6/1965 | Ricketts . | |
| 3,633,467 | | 1/1972 | Watanabe | 92/172 |
| 3,707,113 | | 12/1972 | Hein et al. | 92/248 |
| 3,741,077 | | 6/1973 | Hulsebus et al. | 92/57 |
| 3,896,707 | | 7/1975 | Holmstrom | 92/172 |
| 3,915,074 | | 10/1975 | Bristow et al. | 92/172 |
| 3,984,904 | | 10/1976 | Schlecht | 29/156.5 R |
| 3,986,439 | | 10/1976 | Ring | 92/158 |
| 3,999,468 | | 12/1976 | Bristow et al. | 92/248 |
| 4,494,448 | * | 1/1985 | Eystratov et al. | 92/172 |
| 4,519,300 | | 5/1985 | Adomis, Jr. et al. | 92/158 |
| 5,007,332 | * | 4/1991 | Wagenseil | 92/181 |
| 5,072,655 | * | 12/1991 | Adler | 92/160 |
| 5,076,148 | | 12/1991 | Adler | 92/158 |
| 5,216,943 | | 6/1993 | Adler et al. | 92/157 |
| 5,490,446 | | 2/1996 | Engel | 92/157 |

* cited by examiner

*Primary Examiner*—Edward K. Look
*Assistant Examiner*—Thomas E. Lazo
(74) *Attorney, Agent, or Firm*—Zarley, McKee, Thomte, Voorhees & Sease

(57) ABSTRACT

A filled hydraulic piston assembly includes a piston body having first and second ends and a compartment in the piston body extending inwardly from the second end toward the first end. The piston is filled with an insert element which is inserted into the compartment of the piston and then held therein by pushing an annular lip on the second end of the body inwardly and against the adjacent end of the insert element. The insert element is comprised of a material that is less dense than the material of the body but has a higher bulk modulus than hydraulic oil. Oil channels can be formed in a variety of shapes on or around the insert so that oil may flow through the filled piston. The piston insert element can be formed from a variety of materials, such as plastic, magnesium, aluminum or other nonferrous metals. The body is generally comprised of steel.

27 Claims, 10 Drawing Sheets

HYDRAULIC PISTON FILLING

BACKGROUND OF THE INVENTION

The present invention relates to pistons for hydraulic pumps and motors. More particularly, this invention relates to a filling for hydraulic pistons used in pumps and motors. The filled piston of this invention increases the efficiency of the pump or motor at a reasonable cost.

A known technique for reducing the amount of oil that is contained within a hydraulic piston is to fill the normally hollow piston with a solid material. This reduces the amount of oil contained within the piston. The oil within the piston must be compressed during each revolution or pumping cycle.

Hollow piston constructions have been found to produce adverse side effects due mainly to the compressibility of the oil which fills the piston cavity. The compressibility of the fluid has a marked effect upon the overall efficiency of the unit, and also produces cavitation, erosion, noise and undesirable moments on the swashplate mechanism when used in an axial piston type of pump or motor.

There are currently at least three known types of "filled" hollow pistons: welded pistons, solid pistons, and plastic-filled pistons. Welded pistons are costly to manufacture because of the welding process. Welded pistons also require that a drilled orifice be provided through the unit for lubrication of the slipper running face. These drilled holes are usually relatively long and small in diameter. Therefore, the drilling process is typically quite difficult and expensive.

Solid pistons also reduce the oil volume. However, solid pistons are much heavier than their hollow counterparts and therefore reduce the speed capability of the hydraulic unit. Similar to welded pistons, solid pistons have a small hole therethrough which requires an expensive drilling operation to ensure lubrication for the slipper running face.

Filling the pistons by pouring a liquid plastic material into them has also been tried. When solidified, the plastic has a bulk modulus greater than that of oil. This method has proven to be costly, and it has been difficult to reliably retain the material within the piston or adhere it to the piston wall. Many plastics do not meet the bulk modulus requirement.

It has been difficult to adapt the conventional "filled" pistons described above to lower-pressure hydraulic units. Thus, the lower-pressure hydraulic units do not get the benefit of the reduced oil volume because they are typically lower-cost units, and the market will not tolerate the additional cost of the non-hollow pistons.

Therefore, a primary objective of the present invention is the provision of a filled piston which is economical to produce and wherein the material which fills the piston is easily secured within the piston.

A further objective of the present invention is the provision of a piston filling having a bulk modulus greater than oil.

A further objective of the present invention is the provision of a filled piston which can be incorporated into low-pressure hydraulic units at a reasonable cost.

A further objective of the present invention is the provision of a piston filling which eliminates the need for secondary operations such as drilling.

A further objective of the present invention is the provision of a lightweight filling for a piston.

A further objective of the present invention is the provision of a lightweight piston filling which can be produced by relatively inexpensive casting or extrusion methods.

A further objective of the present invention is the provision of a filled piston which has an improved structure for retaining the filling therein.

These and other objectives will be apparent from the drawings, as well as from the description and claims which follow.

SUMMARY OF THE INVENTION

The present invention relates to a filled piston assembly for a hydraulic pump or motor. The filled hydraulic piston assembly includes a piston body having first and second ends and a cavity or compartment in the piston body extending inwardly from one of the ends. The piston is filled with an insert element which is inserted into the compartment of the piston and then held therein by pushing an annular lip on the adjacent end of the body inwardly and against the adjacent end of the insert element. The insert element is comprised of a material that is less dense than the material of the body but has a higher bulk modulus than hydraulic oil. Oil channels can be formed in a variety of shapes on the insert or between the insert and the piston body so that oil may flow through the piston. The piston insert element can be formed from a variety of materials, such as plastic, magnesium, aluminum or other nonferrous metals. The body is generally comprised of steel.

DETAILED DESCRIPTION OF THE PREFERRED EMBODIMENTS

Figure 1:
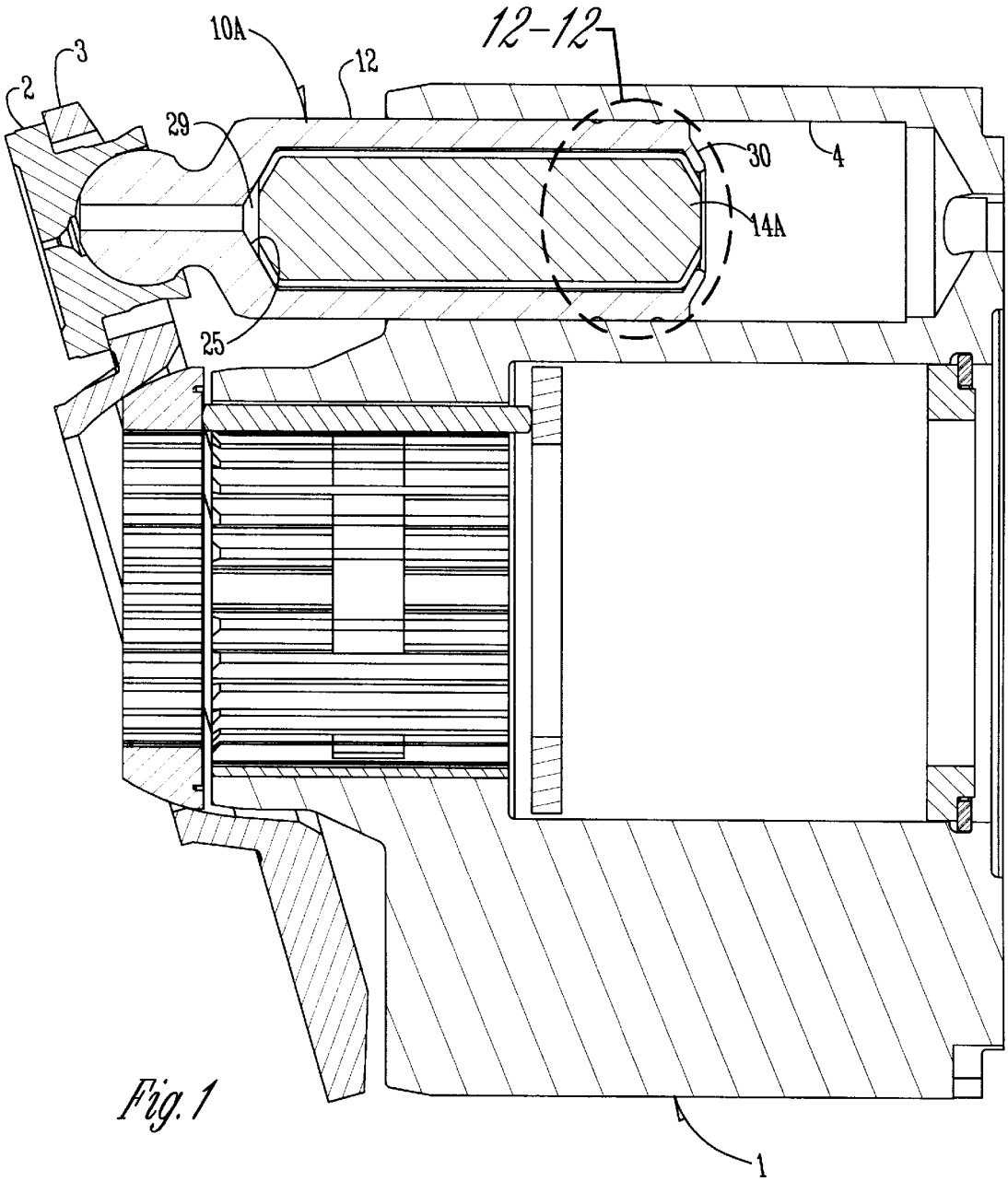
FIG. 1 is a cross-sectional view of one embodiment of the filled piston of this invention installed in the cylinder block of a hydraulic unit.
Figure 2:
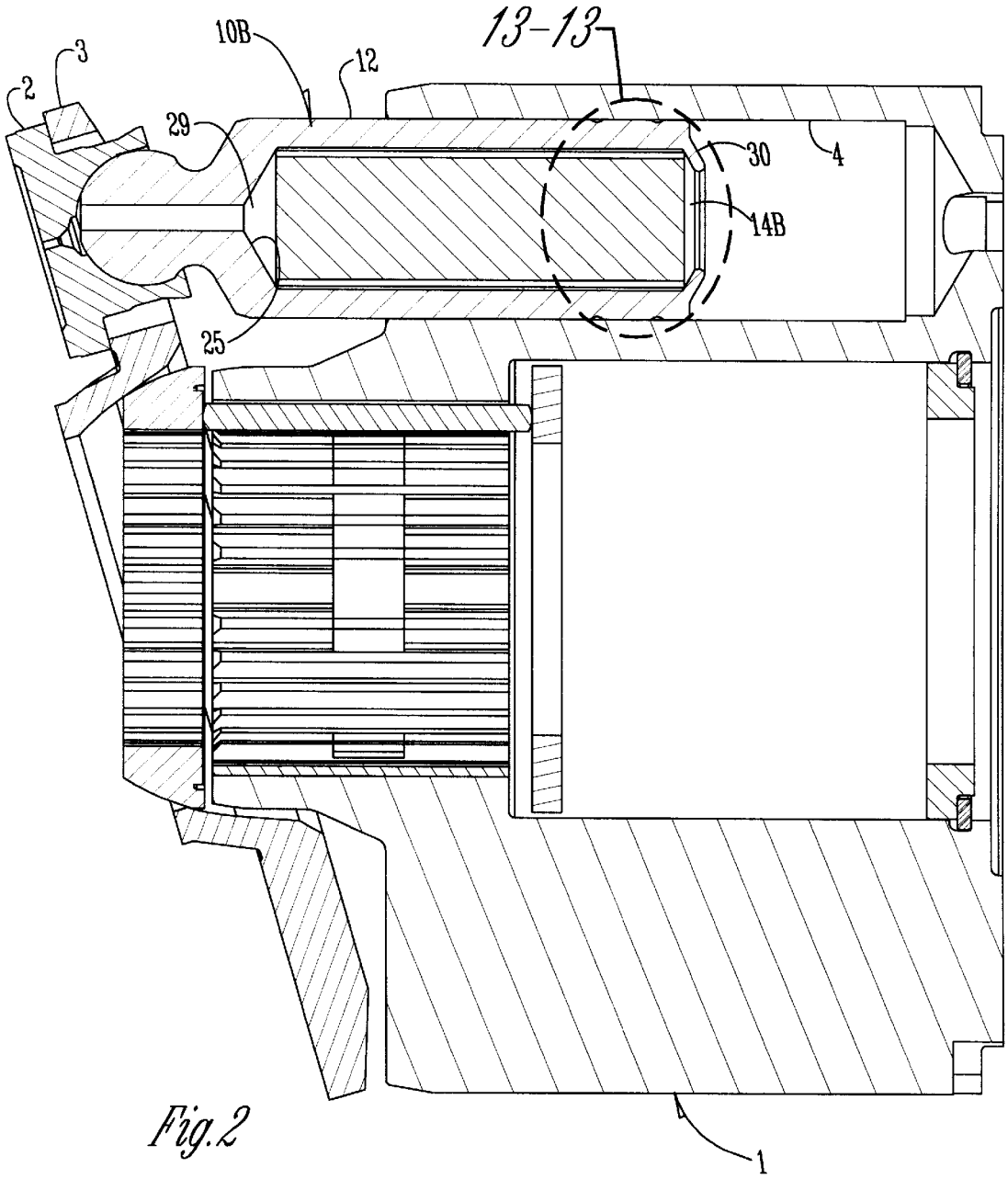
FIG. 2 is a cross-sectional view of another embodiment of the filled piston of this invention installed in the cylinder block of a hydraulic unit.

The filled hydraulic piston assembly of this invention is generally designated by the reference numeral 10A or 10B in the figures. Referring to FIGS. 1 and 2, the two major components of the filled piston assemblies 10A, 10B are a hollow piston 12 and a piston insert 14A, 14B. The piston assemblies 10A, 10B are movably mountable in a cylinder block 1. A slipper 2 pivotally attaches to the exposed end of the piston 12. A slipper retainer 3 helps the slipper 2 move in a coordinated manner against a conventional swashplate (not shown) while the cylinder block 1 rotates, as is well known with respect to axial piston hydraulic pumps and motors.

Figure 3:
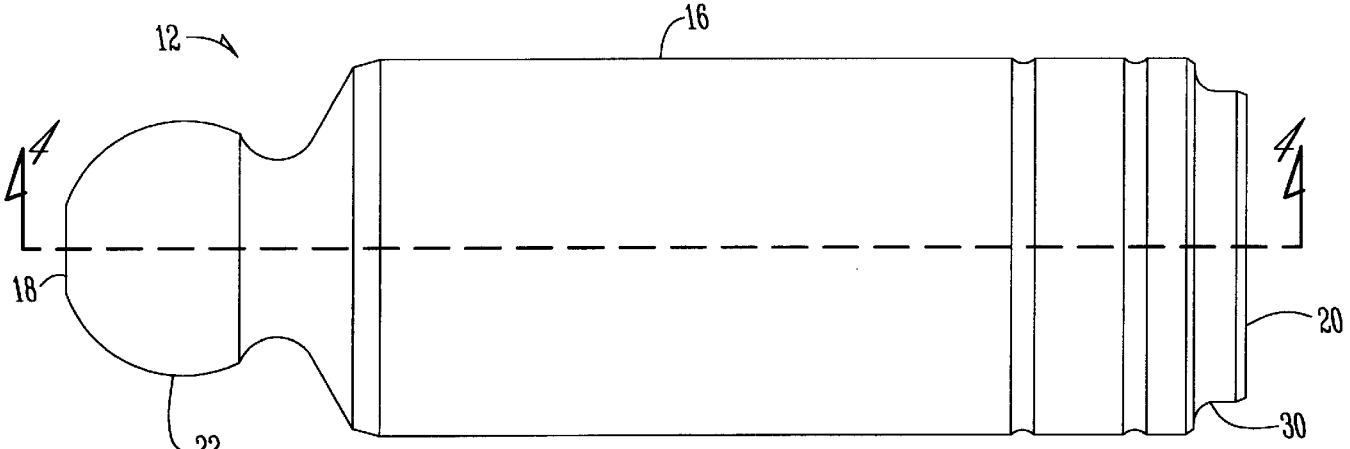
FIG. 3 is a side elevation view of the piston for this invention.
Figure 4:
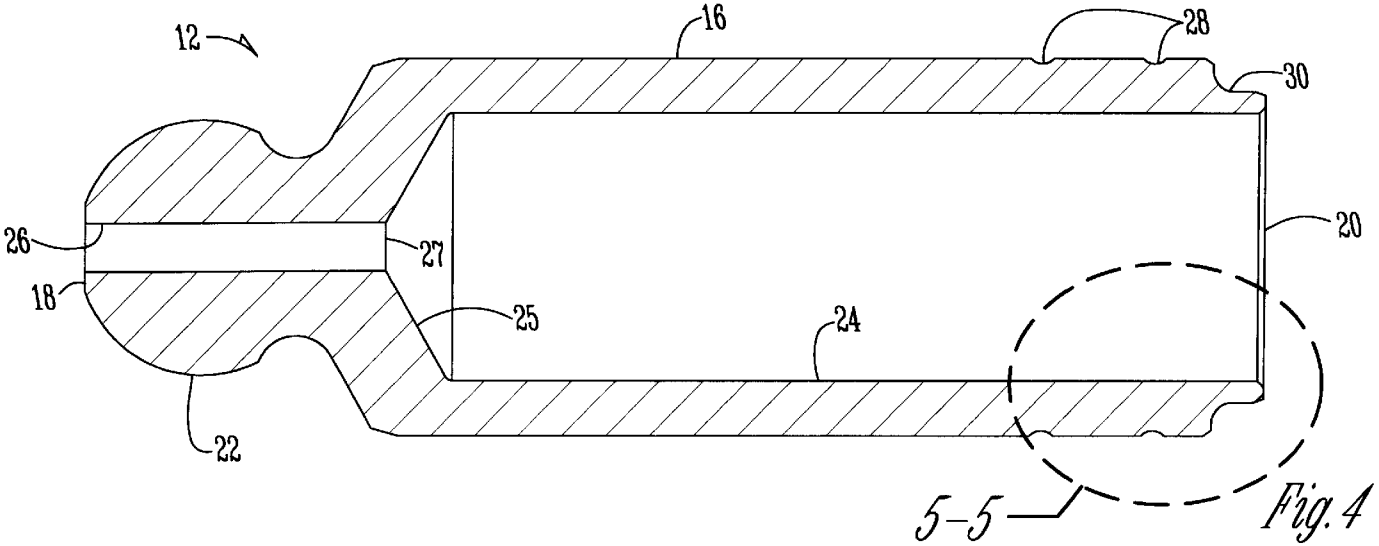
FIG. 4 is a central longitudinal cross-sectional view of the piston of FIG. 3.
Figure 5:
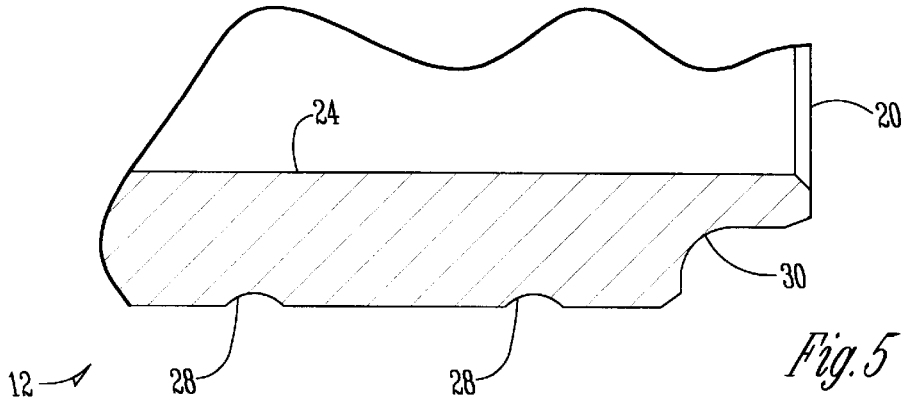
FIG. 5 is an enlarged partial cross-sectional view of the piston taken from the area designated 5—5 in FIG. 4.

Referring to FIGS. 3–5, the hollow piston 12 has a cylindrical piston body 16 having first and second ends 18, 20. A spherically shaped head 22 is formed on the first end 18 of the piston 12. A cylindrically shaped compartment 24 is formed in the piston body 16. The compartment extends from the second end 20 of the piston body 16 to a position adjacent the head 22. An oil channel 26 extends through the head 22 and is in fluid communication with the compartment 24. The compartment 24 has a tapered portion 25 adjacent the head 22. The oil channel 26 has an inner end 27 which fluidly connects to the tapered portion 25 of the compartment 24. As is conventional, the piston body 16 can include one or more external annular balance grooves 28 adjacent the second end 20.

An annular lip 30 is formed on the second end 20 of the piston body 16. The lip 30 initially projects outward in a longitudinal direction with respect to the piston body 16. Typically the piston body 16 is formed of a steel material.

The piston insert 14 is made of a material that is substantially rigid but less dense than the material of the piston body 16. The material also has a bulk modulus which is greater than hydraulic oil. Phenolic plastics have been found to exhibit excellent properties and work well for the insert 14 of this invention.

Two possible configurations for the piston insert are disclosed herein. FIGS. 6–8 and 12 show a piston insert 14A which can be cast from magnesium, plastic, aluminum, or other similar lightweight nonferrous materials. FIGS. 9–11 and 13 show an extruded piston insert 14B.

Figure 6:
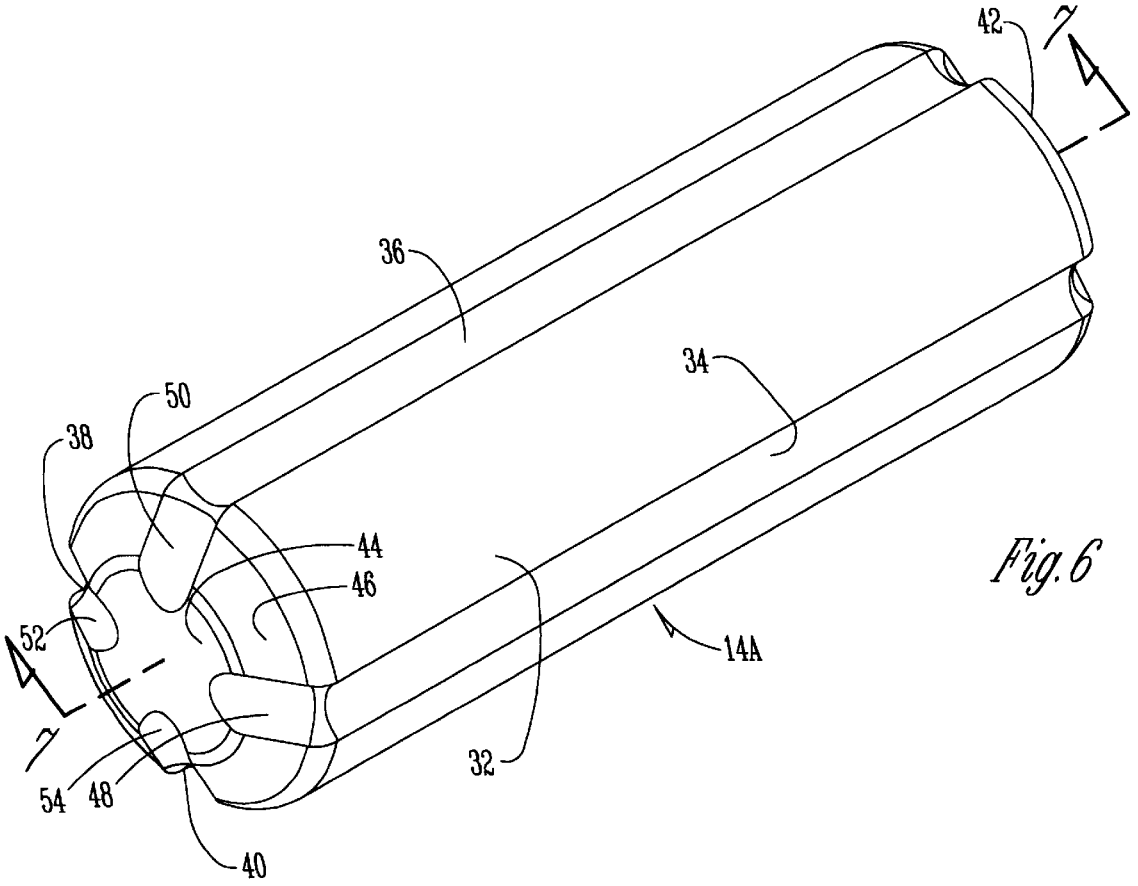
FIG. 6 is a perspective view which shows the molded or cast embodiment of the piston insert or filling of this invention.
Figure 7:
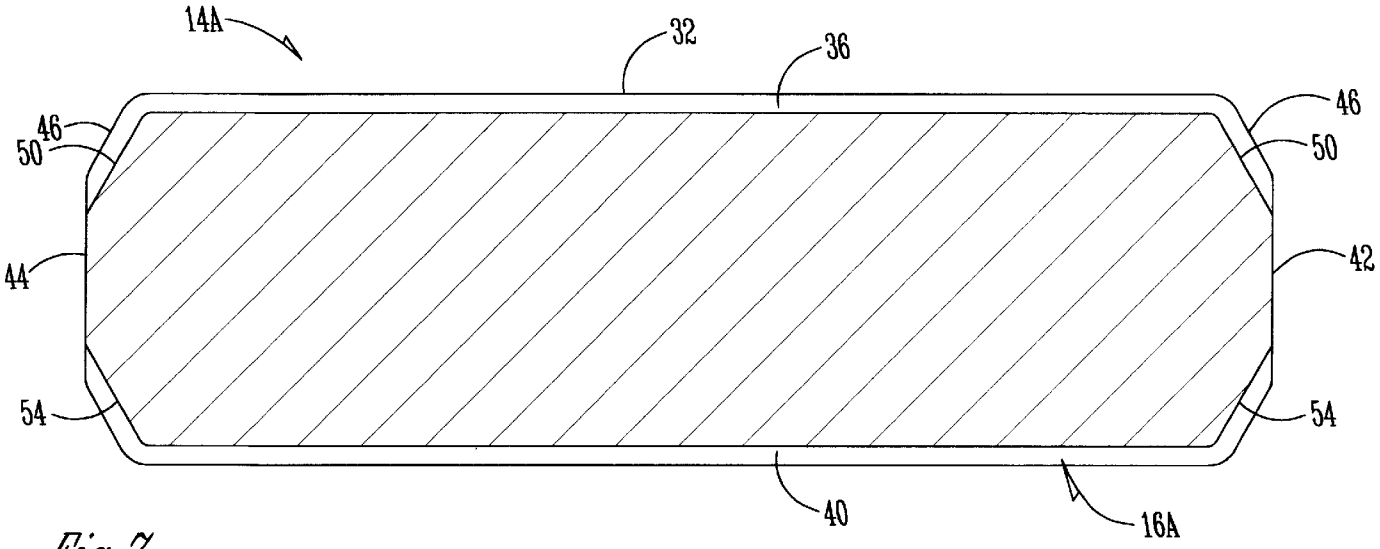
FIG. 7 is a central longitudinal cross-sectional view of the piston insert of FIG. 6.
Figure 8:
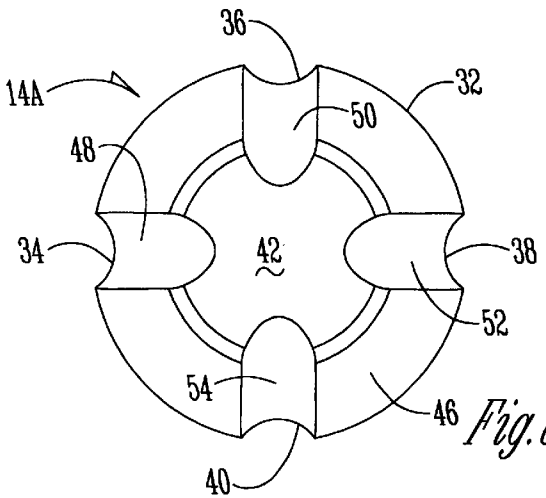
FIG. 8 is an end view of the piston insert of FIG. 6. Only one end is shown because the left and right ends are mirror images of each other.
Figure 9:
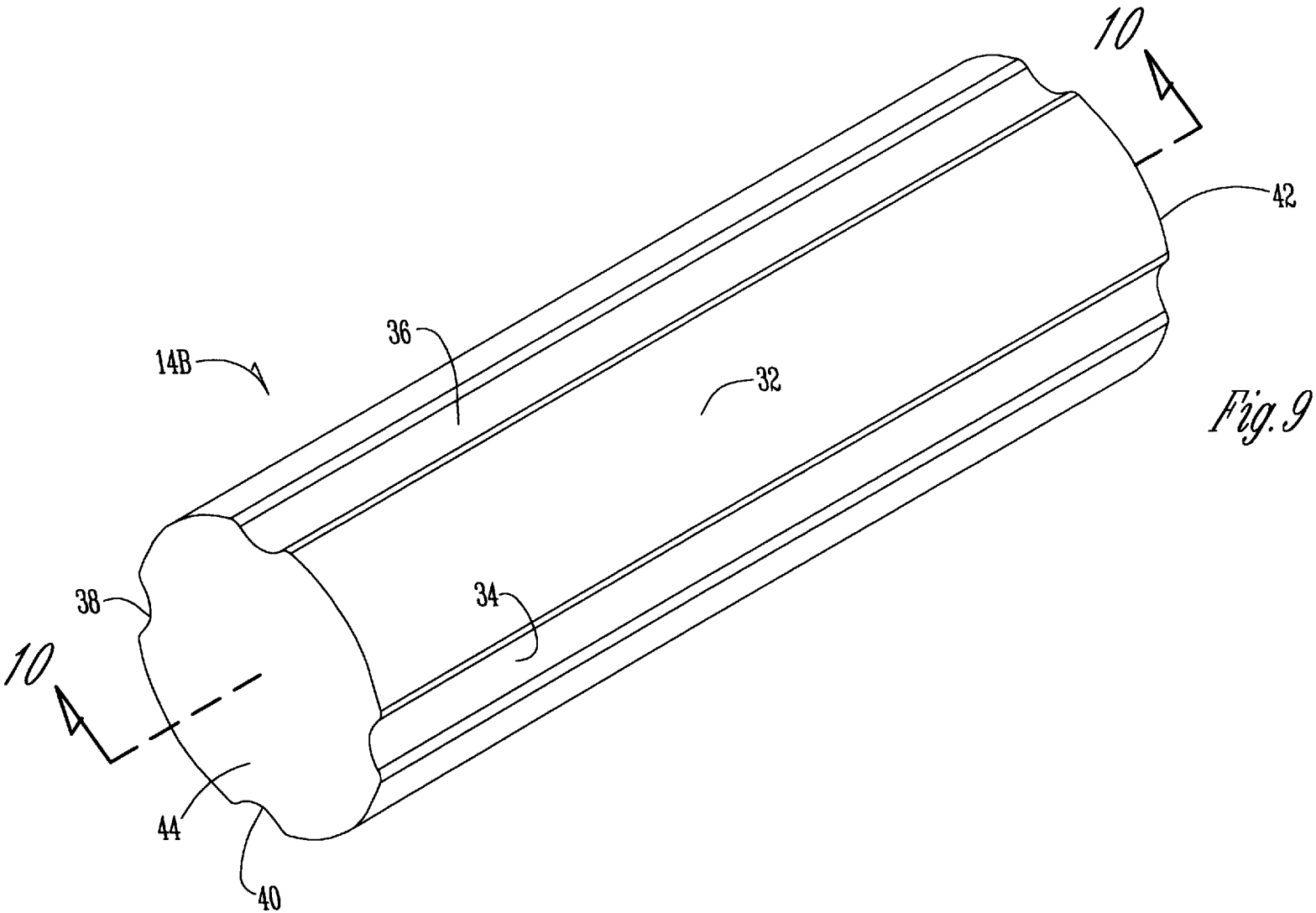
FIG. 9 is a perspective view of the extruded embodiment of the piston insert of the present invention.
Figure 11:
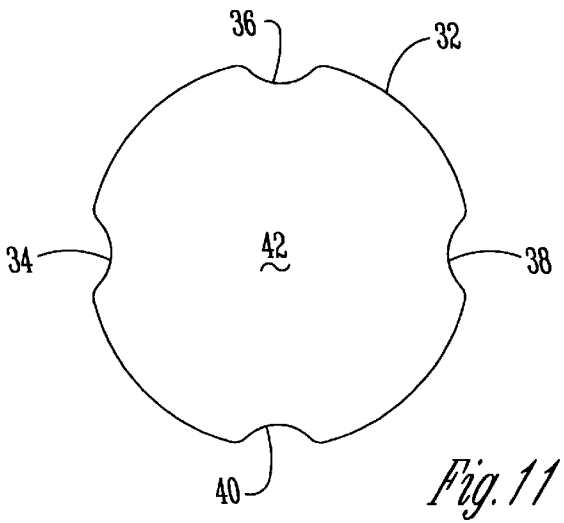
FIG. 11 is an end view of the piston insert of FIG. 9. Only one end is shown because the left and right ends are mirror images of each other.
Figure 10:
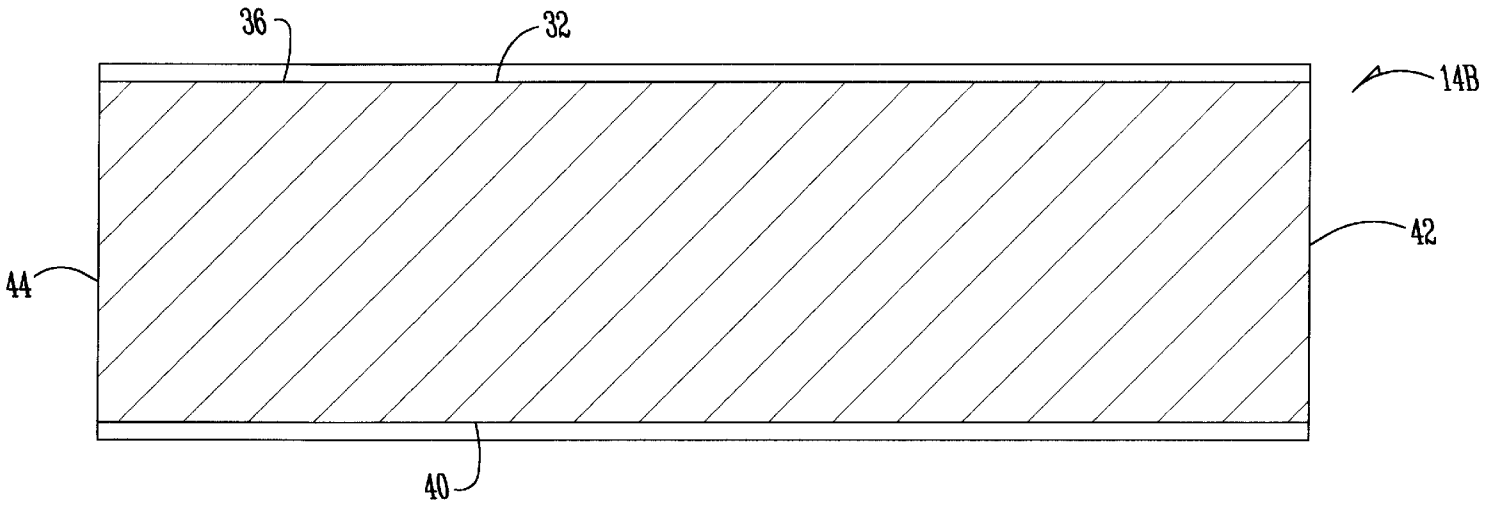
FIG. 10 is a longitudinal cross-sectional view of the piston insert taken along line 10—10 in FIG. 9.
Figure 12:
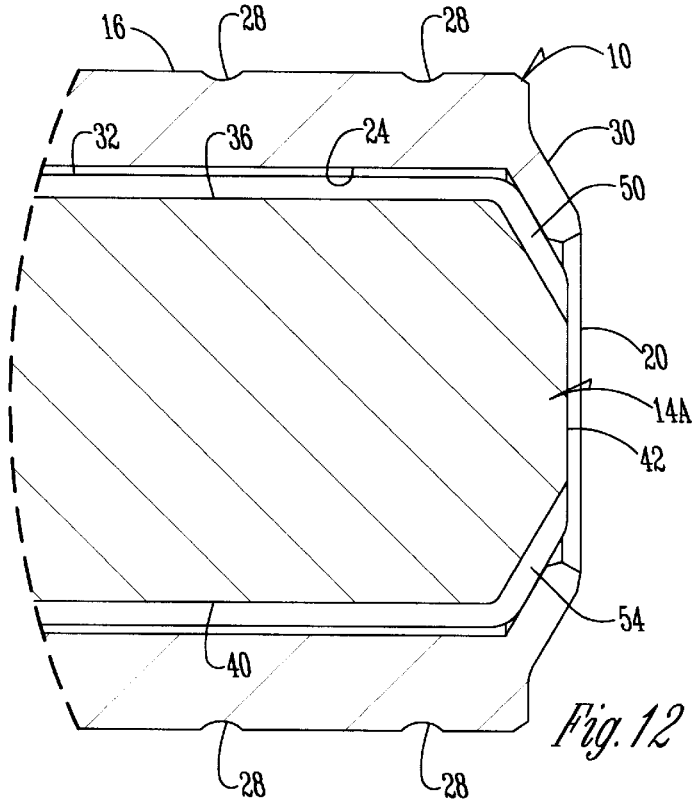
FIG. 12 is an enlarged partial cross-sectional view taken of the area designated 12—12 in FIG. 1 and shows the retention of the cast insert.
Figure 13:
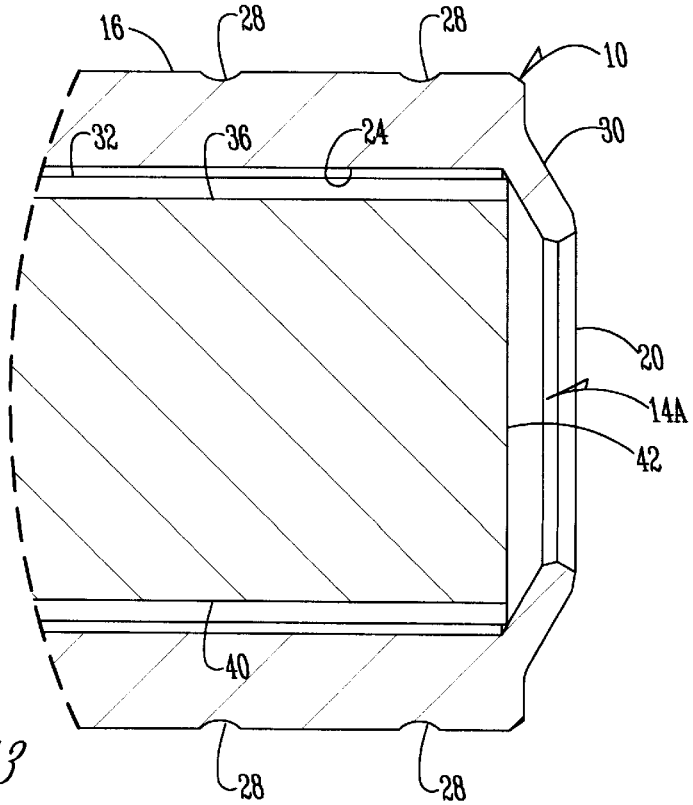
FIG. 13 is an enlarged partial cross-sectional view taken of the area designated 13—13 in FIG. 2 and shows the retention of the extruded insert.

Referring to FIGS. 6–8, the molded or cast piston insert 14A is a substantially cylindrical bar or column and has an outer cylindrical surface 32. A plurality of straight elongated oil channels 34, 36, 38 and 40 are formed in the outer cylindrical surface 32. The oil channels 34, 36, 38, 40 are preferably equally spaced around the surface 32 and are arcuately shaped for efficient fluid flow and ease of casting. The piston insert 14A has opposite ends 42, 44. The oil channels 34, 36, 38, 40 extend along the entire length of the outer cylindrical surface 32. A chamfer 46 is formed at both ends 42, 44 of the piston insert 14A. Preferably the chamfer 46 extends at an angle of approximately 30° with respect to the ends 42, 44. A plurality of oil channels 48, 50, 52, 54 are formed on the chamfer 46. The oil channels 48, 50, 52, 54 are similar to, aligned with, and fluidly connected to the oil channels 34, 36, 38, 40. The oil channels 48, 50, 52, 54 extend radially outward at the respective ends 42, 44 to the oil channels 34, 36, 38, 40 on the outer cylindrical surface 32. The channels allow oil to flow around the piston insert 14A, through a space 29 provided by the tapered portion 25 of the compartment, and through the channel 26 at the head 22 of the piston 12 so as to lubricate the slipper/swashplate running face.

In another embodiment of the piston insert 14B shown in FIGS. 9–11 and 13, the material is extruded and cut to the desired length. Because the transverse cross-section of the material is relatively uniform, the extrusion process can be effectively utilized. The structure of the extruded piston insert 14B is similar to its cast counterpart 14A. Oil channels 34, 36, 38, 40 are still provided, as previously described. However, no chamfers or additional oil channels on the ends 42, 44 are provided because these features would require additional machining and raise the cost of the insert 14B. Preferably the oil channels 34, 36, 38, 40 are straight and equally spaced around the surface 32 of the piston insert 14B.

Regardless of the configuration of piston insert used, the filled piston assembly 10A, 10B is assembled in substantially the same manner. See FIGS. 1–2 and 12–13. The piston insert 14A, 14B is inserted into the compartment 24 of the piston body 16. Because the ends 42, 44 of the piston insert 14A, 14B are identical, it does not matter which end is inserted first. However, for the purpose of the following explanation only, it is assumed that the end 44 has been inserted first. Once the piston insert 14A, 14B is fully inserted in the compartment so that the chamfer 46 or the end 44 abuts the tapered portion 25 of the piston compartment 24, the visible end 42 is disposed below the lip 30. The lip 30 is then pushed inwardly with sufficient force so that it permanently deforms to project inwardly against the visible chamber 46 or end 42 of the piston insert 14A, 14B. This can be accomplished with any number of conventional processes, including but not limited to rolling, swaging or crimping.

One will notice that the chamfers 46 of the cast or molded piston insert 14A make it fit especially well in the closed compartment 24. The chamfers have the same angles (30 degrees) with respect to the surface 32 as the tapered ends of the closed compartment 24. The cast piston insert is also well adapted to be retained by the lip 30 which is pushed inwardly to an angle of approximately 30° with respect to the end of the piston body 16. The lip 30 projects inwardly at an angle of approximately 30° with respect to the end of the piston body 16. At any rate, the lip 30 rests against the chamfer 46 or the adjacent end 42 of the respective insert elements 14A, 14B. The piston inserts 14A, 14B are therefore securely retained in the hollow pistons 12 and define a filled piston assembly 10 which is functional, lightweight and economical to manufacture.

Figure 14:
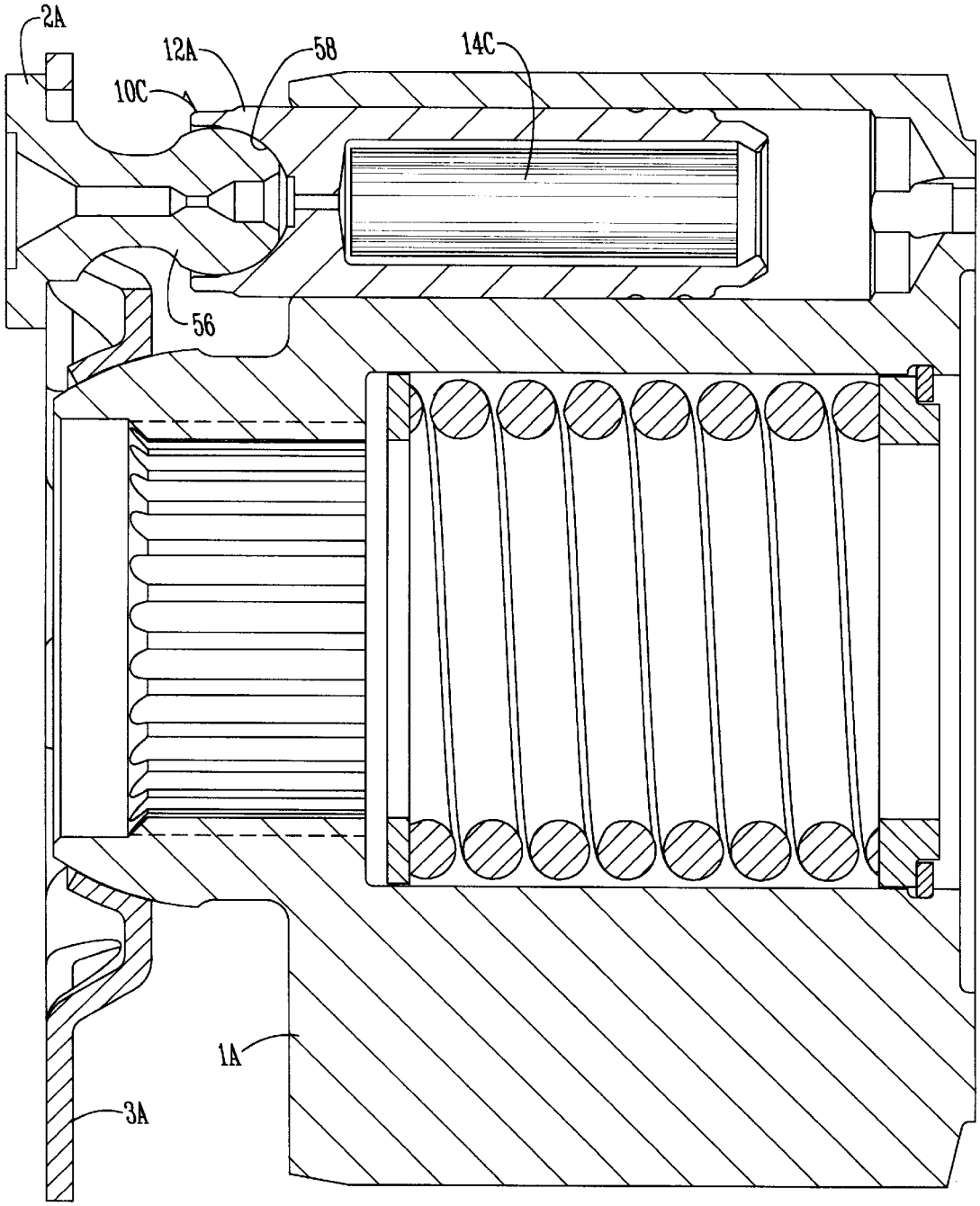
FIG. 14 is a cross-sectional view of another embodiment of the filled piston of this invention installed in the cylinder block of a hydraulic unit wherein a different slipper/piston interface and connection is utilized.

Another embodiment of this invention is shown in FIGS. 14–18. In this embodiment, the piston-slipper joint is defined by a partially spherical ball 56 on the slipper 2A and a mating socket 58 on the piston 12A. As seen in FIG. 14, the piston filler or insert 14C is captured within the piston 12A as described above. A plurality of the pistons 12A are axially reciprocable in the cylinder block 1A. The associated slippers 2A are tiltably mounted on the cylinder block 1A by a slipper retainer 3A in a conventional manner.

Figure 15:
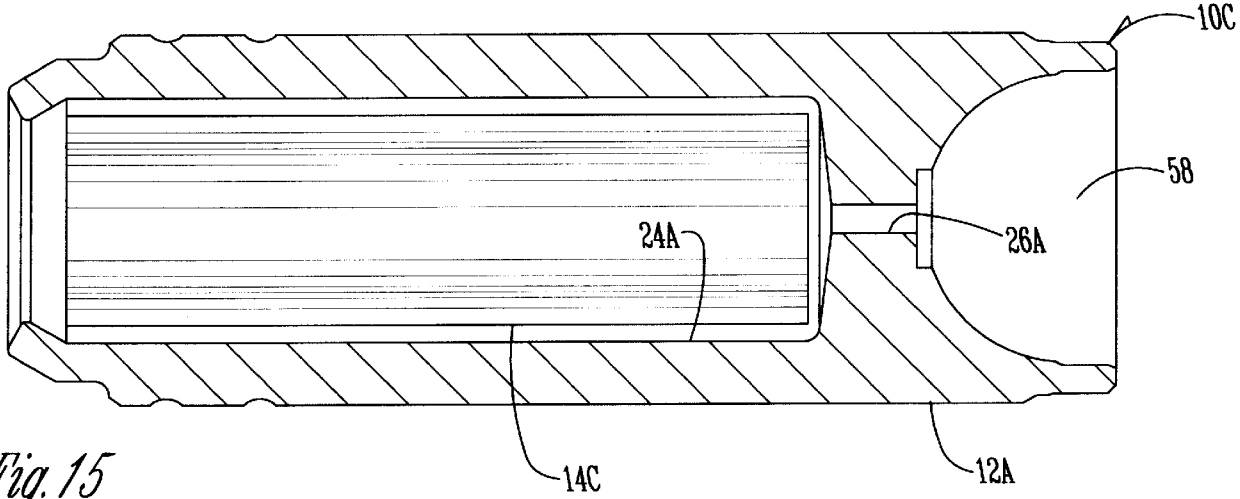
FIG. 15 is a central longitudinal cross-sectional view of the piston assembly of FIG. 14.

In FIG. 15, the piston 12A is shown in greater detail. An oil channel or passage 26A extends from the socket 58 into a compartment 24A located therebelow. In the same manner as previously described, the piston insert or filler 14C is captured or held in the compartment 24A.

Figure 17:
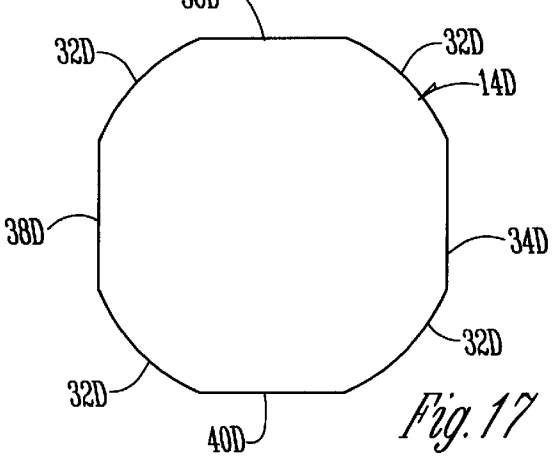
FIGS. 16–18 are end views of the piston insert showing various possible configurations for the oil channels formed around the piston insert.
Figure 18:
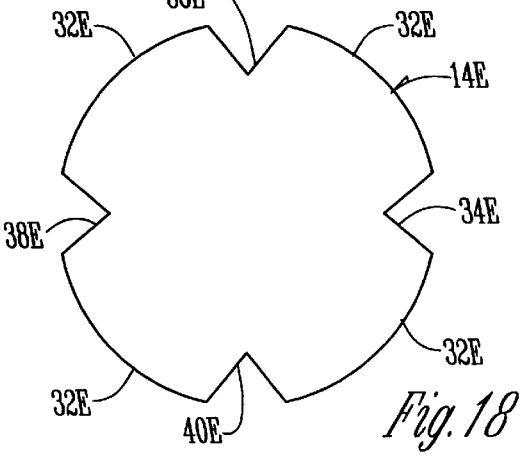
Figure 16:
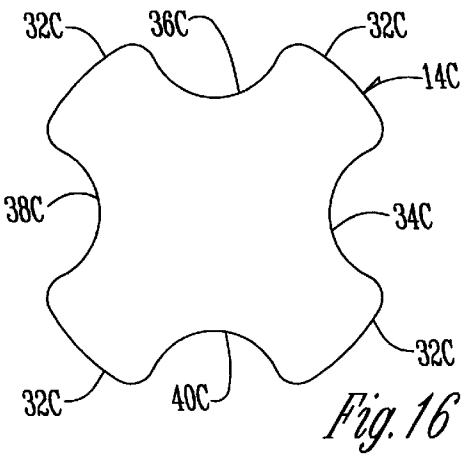

FIG. 16 shows an end view of the piston insert 14C. The piston insert 14C has an irregularly shaped outer surface 32C because oil channels 34C, 36C, 38C, 40C formed therein make a radiused "X" or "plus sign" shape. Two of the many other possible oil channel configurations on the outer surface of the piston insert are shown in FIGS. 17 and 18. In FIG. 17, the outer surface 32D of the piston insert 14D has several flats 34D, 36D, 38D, 40D formed thereon which define the oil channels. FIG. 18 shows a piston insert 14E having an outer surface 32E with a plurality of spaced apart V-shaped grooves 34E, 36E, 38E, 40E formed therein to define the oil channels.

In its simplest form, the present invention is directed to the inclusion of oil channels along the outer surface of the piston insert. These oil channels can be in numerous physical shapes and still fulfill their intended purpose or function of allowing oil to flow through space(s) between the piston insert and the wall of the compartment in the piston. In fact, it is even contemplated that the piston insert could be substantially cylindrical, while the compartment could have a non-circular cross-section, which would allow oil flow around the outer surface of the piston insert. In other words, the oil channels of the present invention are not shape dependent.

Thus, the present invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A hydraulic piston assembly, comprising:

a cylindrical piston body having first and second ends;

a spherically shaped head on the first end;

a compartment in the piston body extending from the second end of the piston body to a position adjacent the head;

an insert element in the compartment and substantially filling the compartment; and an annular lip on the second end of the body projecting inwardly and against an adjacent end of the insert element to rigidly hold the insert element within the compartment;

the insert element being comprised of a material that is less dense than the material of the body;

wherein the insert element has an outer cylindrical surface, with a plurality of elongated oil channels formed in the outer cylindrical surface and extending the length of the outer cylindrical surface.

2. The piston assembly of claim 1 wherein the insert element is comprised of a material from the group of plastic, magnesium or nonferrous metal, and the body is comprised of steel.

3. The piston assembly of claim 1 wherein an oil channel extends through the head and is in fluid communication with the compartment and the channels in the outer cylindrical surface of the insert element.

4. The piston assembly of claim 3 wherein an end of the cylindrically shaped compartment adjacent the head is tapered to provide a space between the insert element and an inner end of the oil channel extending through the head.

5. The piston assembly of claim 1 wherein the channels in the outer surface of the insert element terminate in radially extending channels in the ends of the insert element.

6. The piston assembly of claim 1 wherein the insert element is substantially rigid.

7. The piston assembly of claim 1 wherein the insert element comprises a cast bar.

8. The piston assembly of claim 1 wherein the insert element comprises a cut segment from an extruded length of material.

9. The piston assembly of claim 1 wherein the lip projects inwardly at an angle of approximately 30° with respect to an adjacent end of the piston.

10. The piston assembly of claim 1 wherein the lip on the second end of the body is crimped so as to permanently deform and project inwardly and against the adjacent end of the insert element.

11. The piston assembly of claim 1 wherein the lip on the second end of the body is swaged so as to project inwardly and against the adjacent end of the insert element.

12. The piston assembly of claim 1 wherein the material of the insert element has a bulk modulus greater than hydraulic oil.

13. The piston assembly of claim 1 wherein the plurality of enlongated oil channels formed in the outer cylindrical surface are V-shaped in a transverse cross-section.

14. The piston assembly of claim 1 wherein the plurality of elongated oil channels are defined by a plurality of spaced apart and elongated flat surfaces extending into the outer cylindrical surface.

15. The piston assembly of claim 1 wherein the plurality of elongated oil channels comprise a plurality of spaced apart indentations formed in the outer cylindrical surface.

16. The piston assembly of claim 15 wherein the indentations are formed as a substantially full radius extending between adjacent portions of the outer cylindrical surface.

17. The piston assembly of claim 1 wherein the compartment is cylindrical in shape.

18. The piston assembly of claim 1 wherein the insert element has a substantially cylindrically shaped outer surface.

19. An insert device for a hollow hydraulic piston having a piston body with an elongated cavity therein having a cavity wall, comprising:

an elongated bar formed of a material that is less dense than the piston body and has a bulk modulus greater than hydraulic oil;

the bar having opposite ends and an outer surface adapted to be insertable into the elongated cavity of the piston body so as to form at least one elongated oil channel between the outer surface and the cavity wall, the channel extending from one end of the bar to the other end of the bar.

20. The device of claim 19 wherein the cavity is substantially cylindrical.

21. The device of claim 19 wherein the bar is substantially cylindrical.

22. The device of claim 19 wherein the at least one channel comprises a plurality of channels formed in the outer surface of the bar and spaced apart therearound.

23. The device of claim 22 wherein channels are spaced such that the bar has a traverse cross-section that resembles a plus sign.

24. The device of claim 22 wherein at least some of the channels have a V shape in a traverse cross-section.

25. The device of claim 22 wherein the channels are formed by a plurality of spaced apart concave troughs in the outer surface.

26. The device of claim 25 wherein a full radius defines at least a portion of one of the troughs.

27. The device of claim 19 wherein one of the at least one channels is at least partially defined by a flattened area extending longitudinally along the outer surface.

* * * * *